US006729060B1

(12) United States Patent
Rietkerk

(10) Patent No.: US 6,729,060 B1
(45) Date of Patent: May 4, 2004

(54) CORNER FITTING FRAME

(76) Inventor: Carla Rietkerk, 3648 Oakbrook La., Panama City, FL (US) 32408

( * ) Notice: Subject to any disclaimer, the term of this patent is extended or adjusted under 35 U.S.C. 154(b) by 0 days.

(21) Appl. No.: 10/391,853

(22) Filed: Mar. 20, 2003

(51) Int. Cl.[7] ..... A47G 1/06
(52) U.S. Cl. ..... 40/738
(58) Field of Search ..... 40/738, 743, 700; D6/300

(56) References Cited

U.S. PATENT DOCUMENTS

| | | | | | |
|---|---|---|---|---|---|
| 363,142 | A | | 5/1887 | Horten | |
| 1,681,586 | A | | 8/1928 | Kessler | |
| 2,991,577 | A | * | 7/1961 | Bellocchio | 40/738 |
| 3,041,762 | A | | 7/1962 | Knox | |
| 3,779,504 | A | | 12/1973 | Schwartz et al. | |
| 3,952,437 | A | | 4/1976 | Mitchell | |
| 4,011,672 | A | * | 3/1977 | Grusin | 40/738 |
| 4,074,453 | A | | 2/1978 | Knox | |
| 4,622,769 | A | | 11/1986 | Friedman | |
| 4,750,283 | A | | 6/1988 | Halpern | |
| 5,373,654 | A | * | 12/1994 | Whalen | 40/716 |
| 5,505,421 | A | | 4/1996 | Marthaler | |
| 5,619,816 | A | | 4/1997 | Ellison | |
| D382,120 | S | * | 8/1997 | Lanci et al. | D6/300 |
| 5,822,896 | A | | 10/1998 | Milstein | |
| 5,857,654 | A | | 1/1999 | Berman | |
| 5,911,398 | A | | 6/1999 | Van Landingham, Jr. | |
| 6,129,323 | A | | 10/2000 | Mandokoro et al. | |
| 6,293,038 | B1 | | 9/2001 | Chang | |
| D448,936 | S | * | 10/2001 | Duy | D6/300 |
| 6,349,915 | B1 | | 2/2002 | Jones et al. | |
| 6,421,942 | B1 | | 7/2002 | Galello | |
| 6,449,891 | B1 | | 9/2002 | Miska | |

* cited by examiner

*Primary Examiner*—Gary Hoge
(74) *Attorney, Agent, or Firm*—Peter Loffler

(57) ABSTRACT

A frame that holds an artist's canvas for creating a work of art thereon and for subsequent display of the work so created uses a body member that has a front surface that is curved and a rear surface that has a first generally flat section and a second generally flat section such that the first section and the second section meet in generally normal fashion and such that the body member is hung within a corner of a building, the corner formed by a first wall and a second wall that meet in generally normal fashion such that the first section faces the first wall and the second section faces the second wall.

21 Claims, 2 Drawing Sheets

CORNER FITTING FRAME

BACKGROUND OF THE INVENTION

1. Field of the Invention

The present invention relates to an art working holding frame that allows an artist to engage a canvas in a three dimensional approach and that also allows a finished item of art to be displayed in a corner of a building.

2. Background of the Prior Art

There is a trend underway for creating works of art such as drawings, paintings, sketches, etc., in a three dimensional fashion in order to give the work of art a sense of depth and perspective. Typically, such a work of art is prepared in standard fashion wherein a piece of canvas is placed upon an easel and the artist creates the work thereon. Upon completion, the work of art is displayed in the desired three dimensional perspective by securing the canvas in some appropriate fashion in order to achieve the three dimensional look.

The problems with the above approach include the fact that when the artist is creating the work on a canvas that is present in a standard two dimensional fashion, the artist cannot fully appreciate her creation in its final three dimensional form. The artist must speculate on how the work will look when it is manipulated for display in three dimensions. Oftentimes, the work, in final form, will not achieve the exact look anticipated by the artist.

Additionally, in order to display the artist's work three dimensionally, steps must be taken to so present the work. Typically, such steps are made on an ad hoc basis and are labor and time intensive and may prove quite costly.

Therefore, there exists a need in the art for a device that will allow an artist desiring to creating a work of art that is to be three dimensionally displayed, to be able to create the work in a setting that is representative of the final product to be achieved. Specifically, the canvas upon which the work is to be created must be hung in a three dimensional fashion so as to parallel the final display form of the finished work of art. Additionally, such a device must allow for quick and easy display of the finished art work without the need to employ costly and time and labor intensive measures for such display.

SUMMARY OF THE INVENTION

The corner fitting frame of the present invention addresses the aforementioned needs in the art. Specifically, the corner fitting frame provides a foundation upon which an artist's canvas can be secured and upon which an artist can create a work of art. The corner fitting frame allows the canvas to be secured in a three dimensional fashion in order to allow the artist to create the work in a setting that is representative of the final product to be achieved, specifically, in three dimensions. Additionally, the corner fitting frame provides a device that allows the final finished work of art to be displayed in a three dimensional setting and specifically in a corner of a building, although the frame can also be displayed on an easel, a counter top, a reverse corner, etc. The device achieves its goals in a device that is simple in design and construction and that is easy to use and maintain without the need to make specialized alterations to either the art work or to the location of the work's display.

The corner fitting frame of the present invention is comprised of a body member that has a front surface that is curved and a rear surface that has a first generally flat section and a second generally flat-section such that the first section and the second section meet in generally normal fashion and such that the body member is hung within a corner of a building, the corner of the building being formed by a first wall and a second wall that meet in generally normal fashion such that the first section of the body member faces the first wall and the second section of the body member faces the second wall. A dowel is secured to the body member for increasing the structural integrity of the body member. The dowel is located at the joiner of the first section and the second section. An artist's canvas is secured to the front surface of the body member. A first eyelet is attached to the first section while a second eyelet is attached to the second section in order to hang the frame therefrom.

BRIEF DESCRIPTION OF THE DRAWINGS

Similar reference numerals refer to similar parts throughout the several views of the drawings.

DESCRIPTION OF THE PREFERRED EMBODIMENT

Figure 1:
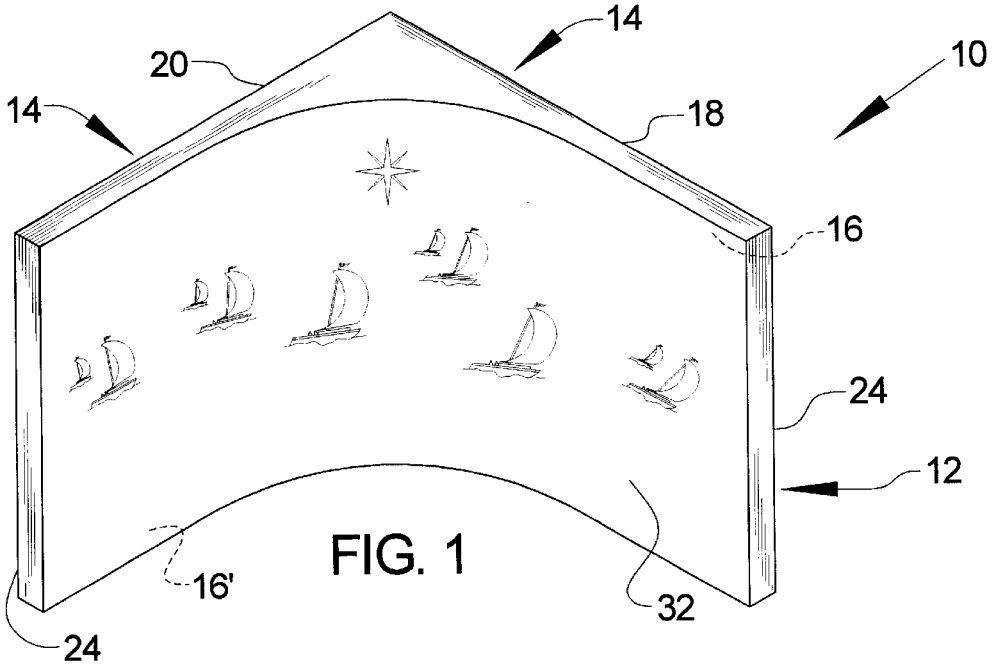
FIG. 1 is a front perspective view of the corner fitting frame of the present invention.
Figure 2:
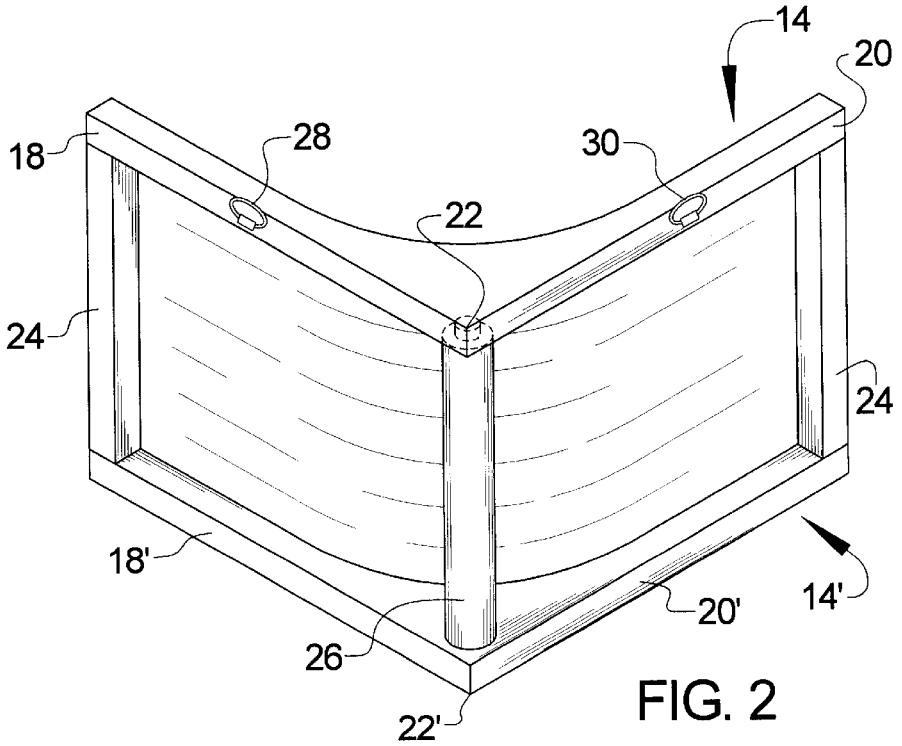
FIG. 2 is a rear perspective view of the corner fitting frame of the present invention.
Figure 3:
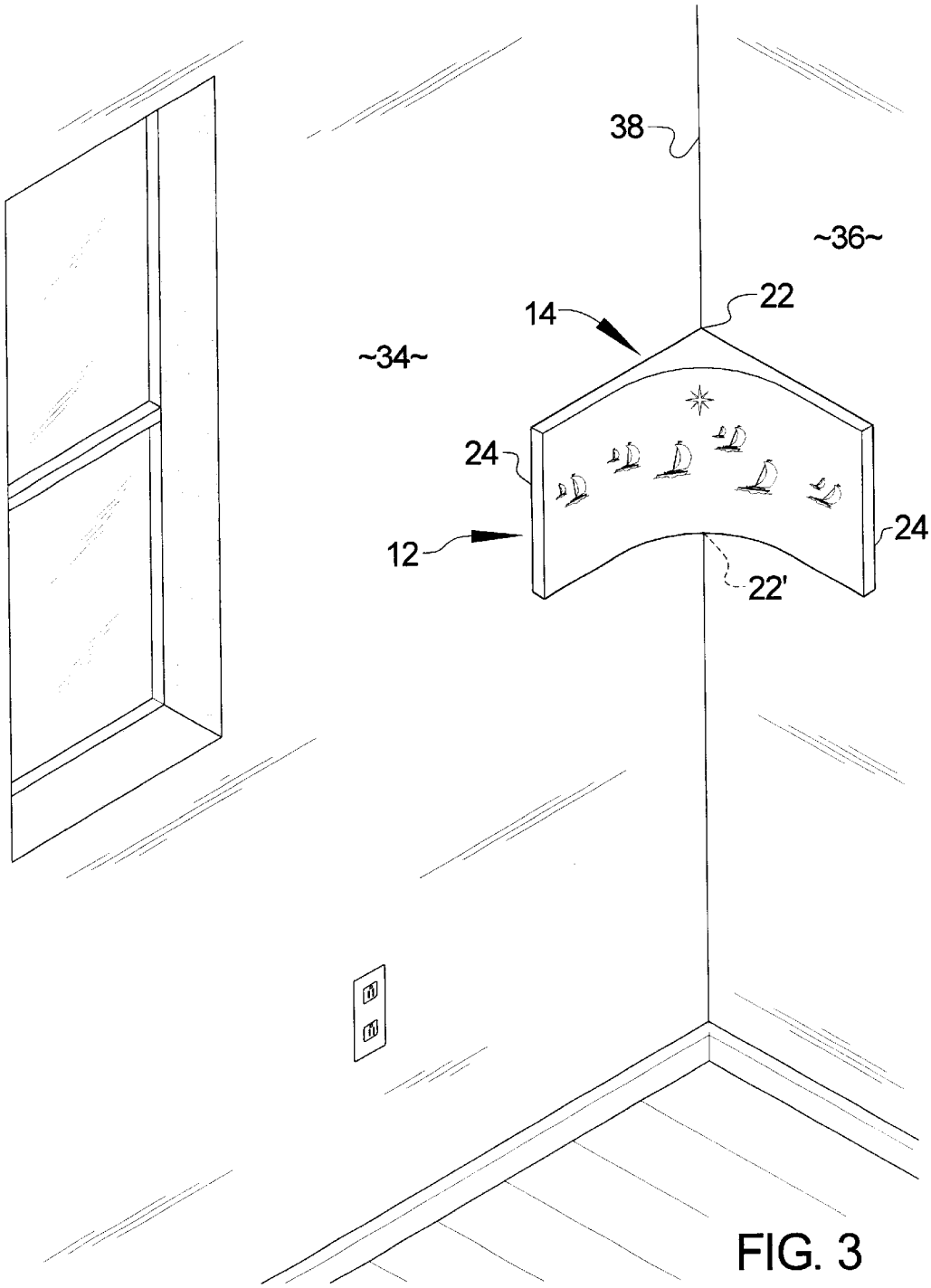
FIG. 3 is an environmental view of the corner fitting frame of the present invention illustrating a work of art being displayed within a corner of a building.

Referring now to the drawings, it is seen that the corner fitting frame of the present invention, generally denoted by reference numeral 10, is comprised of a body member 12 that has a front surface that is curved and a rear surface that has a first generally flat section and a second generally flat section such that the first section and the second section meet in generally normal fashion. As seen, the body member 12 is formed of a first horizontal leg 14 that has a front surface 16 and a rear surface that is formed of a first generally flat subsection 18 and a second generally flat subsection 20, the two subsections 18 and 20 meeting in generally normal orientation at a point 22. As further seen, a second horizontal leg 14' is provided and has a front surface 16' and a rear surface that is formed of a first generally flat subsection 18' and a second generally flat subsection 20', the two subsections 18' and 20' meeting in generally normal orientation at a point 22'. A pair of vertical legs 24 are located at opposed ends of the two horizontal legs 14 and 14' and are used to connect the two legs 14 and 14' in offsetting fashion. If desired, a dowel 26 can be connected between the pair of horizontal legs 14 and 14' intermediate of the pair of vertical legs 24 in order to increase the structural integrity of the body member 12. The dowel may be located proximate the pair of points 22 and 22' formed from the meeting of the respective sections of the pair of horizontal legs 14 and 14', although several dowels can be provided which dowels are dispersed in spaced apart fashion along the length of the two horizontal legs 14 and 14'. A first eyelet 28 is attached to the first subsection 18 of the first horizontal leg 14 while a second eyelet 30 is attached to the second subsection of the first horizontal leg 14. Advantageously, the two eyelets 28 and 30 are located equidistant from the first point 22.

In order to use the corner fitting frame 10 of the present invention, an artist's canvas 32 of any desired construction is secured to the body member 12. Such securement of the canvas 32 to the body member 12 is by any standard fashion and can include stapling the canvas 32 to the body member 12, adhering the canvas 32 to the body member 12, using cooperating hook and loop material (not illustrated) to secure the canvas 32 to the body member 12, etc. Once the canvas 32 is so secured to the body member 12, the body member 12 is positioned on an appropriate structure, such as a table top, easel, etc., and the artist creates work upon the canvas 30. As the canvas 32 is mounted in a three dimensional fashion, the artist has an appreciation of the final look of the work of art being created.

Once the work of art is created, the body member 12 can be hung on the walls of a building at a corner of the building. Specifically, the corner of the building is formed by a first wall 34 meeting a second wall 36 at a corner point 38. The body member 12 is positioned such that the first subsections 18 and 18' of each of the two horizontal legs 14 and 14' respectively face the first wall 34 of the building and the second subsections 20 and 20' of each of the two horizontal legs 14 and 14' respectively, face the second wall 36 of the building and such that the points 22 and 22' of the meetings of the respective subsections 18 and 20 and 18' and 20' are positioned at the corner point 38 of the building. Appropriate nails or hooks (neither illustrated) are placed into the walls 34 and 36 of the building and the eyelets 28 and 30 are received upon the nails or hooks so installed.

It is appreciated that in order to use the corner fitting frame 10 to display a work of art that the work of art need not necessarily be created on the corner fitting frame 10. For example, the artist's canvas 32 may be in the form of a photograph such that the corner fitting frame 10 is used for display only of the photograph and not for the creation of the work itself. Additionally, it is also appreciated that the corner fitting frame 10 may be displayed in other modes than just in the corner of the a building, such as on an easel, on a counter top, on flat section of wall of a building, on a reverse corner of the building, etc. If needed, appropriate frame mounts are placed on the body member 12 in order to secure the frame 10 in one of these alternate positions.

While the invention has been particularly shown and described with reference to an embodiment thereof, it will be appreciated by those skilled in the art that various changes in form and detail may be made without departing from the spirit and scope of the invention.

I claim:

1. A frame comprising:

a pair of horizontal legs, each leg having a front surface that has a central curved portion and a rear surface that has a first generally flat subsection and a second generally flat subsection, such that the first subsection and the second subsection are disposed generally normal to each other;

a pair of vertical legs that are each connected between the pair of horizontal legs in order to secure the horizontal legs in offsetting fashion, at opposing ends of the of the horizontal legs; and a dowel connected between the pair of horizontal legs and located intermediate of the pair of vertical legs.

2. The frame as in claim 1 wherein the dowel is located at the joiner of the first subsection and the second subsection of each of the pair of horizontal legs.

3. The frame as in claim 1 further comprising an artist's canvas secured to each of the horizontal legs and each of the vertical legs.

4. The frame as in claim 1 further comprising:

a first eyelet attached to the first subsection; and a second eyelet attached to the second subsection.

5. A frame comprising a body member that has a front surface that is curved and a rear surface that has a first generally flat section and a second generally flat section such that the first section and the second section meet in generally normal fashion and such that the body member is adapted to be hung within a corner of a building, the corner formed by a first wall and a second wall that meet in generally normal fashion such that the first section faces the first wall and the second section faces the second wall, and wherein a dowel is secured to the body member for increasing structural integrity of the body member.

6. The frame as in claim 5 wherein the dowel is located at the joiner of the first section and the second section.

7. The frame as in claim 6 further comprising an artist's canvas secured to the front surface of the body member.

8. The frame as in claim 5 further comprising:

a first eyelet attached to the first section; and a second eyelet attached to the second section.

9. A frame comprising a body member that has a front surface that is curved and a rear surface that has a first generally flat section and a second generally flat section such that the first section and the second section meet in generally normal fashion at a first point and such that the body member is adapted to be hung within a corner of a building, the corner formed by a first wall and a second wall that meet in generally normal fashion at a second point and such that the first section faces the first wall and the second section faces the second wall and the first point nests within the second point, and wherein a dowel is secured to the body member for increasing structural integrity of the body member.

10. The frame as in claim 9 wherein the dowel is located at the joiner of the first section and the second section.

11. The frame as in claim 9 further comprising an artist's canvas secured to the front surface of the body member.

12. The frame as in claim 9 further comprising:

a first eyelet attached to the first section; and a second eyelet attached to the second section.

13. A frame comprising:

a pair of horizontal legs, each leg having a front surface that has a central curved portion and a rear surface that has a first generally flat subsection and a second generally flat subsection, such that the first subsection and the second subsection are disposed generally normal to each other;

a pair of vertical legs that are each connected between the pair of horizontal legs in order to secure the horizontal legs in offsetting fashion, at opposing ends of the of the horizontal legs; and an artist's canvas secured to each of the horizontal legs and each of the vertical legs.

14. The frame as in claim 13 further comprising:

a first eyelet attached to the first subsection; and a second eyelet attached to the second subsection.

15. A frame comprising:

a pair of horizontal legs, each leg having a front surface that has a central curved portion and a rear surface that has a first generally flat subsection and a second generally flat subsection, such that the first subsection and the second subsection are disposed generally normal to each other;

a pair of vertical legs that are each connected between the pair of horizontal legs in order to secure the horizontal legs in offsetting fashion, at opposing ends of the of the horizontal legs;

a first eyelet attached to the first subsection; and a second eyelet attached to the second subsection.

16. A frame comprising a body member that has a front surface that is curved and a rear surface that has a first generally flat section and a second generally flat section such that the first section and the second section meet in generally normal fashion and such that the body member is adapted to be hung within a corner of a building, the corner formed by a first wall and a second wall that meet in generally normal fashion such that the first section faces the first wall and the second section faces the second wall and an artist's canvas secured to the front surface of the body member.

17. The frame as in claim 16 further comprising:

a first eyelet attached to the first section; and a second eyelet attached to the second section.

18. A frame comprising a body member that has a front surface that is curved and a rear surface that has a first generally flat section and a second generally flat section such that the first section and the second section meet in generally normal fashion and such that the body member is adapted to be hung within a corner of a building, the corner formed by a first wall and a second wall that meet in generally normal fashion such that the first section faces the first wall and the second section faces the second wall with a first eyelet attached to the first section and a second eyelet attached to the second section.

19. A frame comprising a body member that has a front surface that is curved and a rear surface that has a first generally flat section and a second generally flat section such that the first section and the second section meet in generally normal fashion at a first point and such that the body member is adapted to be hung within a corner of a building, the corner formed by a first wall and a second wall that meet in generally normal fashion at a second point and such that the first section faces the first wall and the second section faces the second wall and the first point nests within the second point and an artist's canvas secured to the front surface of the body member.

20. The frame as in claim 19 further comprising:

a first eyelet attached to the first section; and a second eyelet attached to the second section.

21. A frame comprising a body member that has a front surface that is curved and a rear surface that has a first generally flat section and a second generally flat section such that the first section and the second section meet in generally normal fashion at a first point and such that the body member is adapted to be hung within a corner of a building, the corner formed by a first wall and a second wall that meet in generally normal fashion at a second point and such that the first section faces the first wall and the second section faces the second wall and the first point nests within the second point and a first eyelet attached to the first section and a second eyelet attached to the second section.

* * * * *